US006142342A

United States Patent [19]

Lewis

[11] Patent Number: 6,142,342

[45] Date of Patent: Nov. 7, 2000

[54] COUNTER-MOUNTED VISCOUS LIQUID DISPENSER HAVING IMPROVED RESERVOIR ASSEMBLY

[75] Inventor: Richard P. Lewis, Marietta, Ga.

[73] Assignee: Kimberly-Clark Worldwide, Inc., Neehah, Wis.

[21] Appl. No.: 09/322,853

[22] Filed: May 28, 1999

[51] Int. Cl.[7] ..... B67D 5/00

[52] U.S. Cl. ..... 222/180; 222/325; 222/385

[58] Field of Search ..... 222/325, 323, 222/324, 382, 385

[56] References Cited

U.S. PATENT DOCUMENTS

| | | | |
|---|---|---|---|
| 1,875,902 | 9/1932 | Wickwire, Jr. . | |
| 2,556,180 | 6/1951 | Hamilton et al. . | |
| 2,737,329 | 3/1956 | Bolsey . | |
| 2,774,517 | 12/1956 | Teegardin et al. . | |
| 2,796,204 | 6/1957 | Math | 222/324 |
| 2,802,606 | 8/1957 | Altman et al. | 222/324 |
| 3,078,471 | 2/1963 | Knibb . | |
| 3,229,858 | 1/1966 | Lesh . | |
| 3,820,698 | 6/1974 | Franz . | |
| 3,945,772 | 3/1976 | Van de Moortele . | |
| 3,990,611 | 11/1976 | Sojka . | |
| 4,286,736 | 9/1981 | Corsette . | |
| 4,762,475 | 8/1988 | Fuchs . | |
| 4,895,279 | 1/1990 | Schultz . | |
| 5,037,007 | 8/1991 | Deussen . | |
| 5,226,566 | 7/1993 | Brandenburg . | |
| 5,894,963 | 4/1999 | Hirota . | |

OTHER PUBLICATIONS

A promotional flyer entitled "SD–200 Fact Sheet," published by Calmar, Inc., 40 Stirling Road, Watchung, NJ 07060.

PCT International Search Report, Jul. 14, 2000.

*Primary Examiner*—Philippe Derakshani
*Attorney, Agent, or Firm*—Dority & Manning

[57] ABSTRACT

A counted-mounted apparatus for dispensing viscous liquid, such as hand soap, includes an improved reservoir assembly. The reservoir assembly includes a container housing in which a predetermined quantity of the viscous liquid is contained. Bayonet tabs or other suitable means may be provided on the housing to effect direct attachment to a canister top of the dispenser. At least one actuator opening is defined in a top portion of the container housing for receipt of the dispenser's actuator rod. A free distal end of the rod pushes against an engaging element located within the housing. When the engaging element is reciprocatively moved by the actuator rod, a pump device located in the housing functions to push the viscous liquid into a flexible delivery tube. The pump device is preferably a common lotion pump which has been suitably modified.

32 Claims, 7 Drawing Sheets

COUNTER-MOUNTED VISCOUS LIQUID DISPENSER HAVING IMPROVED RESERVOIR ASSEMBLY

BACKGROUND OF THE INVENTION

The present invention relates generally to the art of devices for dispensing a viscous liquid, such as liquid soap. More particularly, the invention relates to counter-mounted viscous liquid dispensers of the type which are often utilized in public washrooms and the like.

A variety of counter-mounted soap dispensers have been provided in the prior art. In one conventional arrangement, a dip tube is inserted into a refillable soap reservoir located below the counter. A dispenser fixture, located above the counter, includes an actuation button that is depressed by a user when a quantity of soap is desired. The dip tube includes a pump which is operated when the actuation button is depressed to draw soap from the reservoir. Simultaneously, soap is pushed through a delivery spout of the dispenser fixture, into the user's hand. Check valves are often provided to ensure that soap will flow only toward the delivery spout, and will not undesirably flow back into the reservoir.

Because these arrangements are permanent installations, the pump and/or valves may fail or become clogged over a period of time. In part to overcome this disadvantage, an alternative arrangement was invented whereby the pump and valves are provided as part of a disposable refill cartridge. As shown in U.S. Pat. No. 5,226,566 to Brandenburg, incorporated herein by reference, this arrangement uses a dispenser fixture having an actuator rod that moves when a user depresses an actuation button. The rod engages a pump piston in the refill cartridge to cause liquid soap to be pumped through a delivery tube. The delivery tube extends completely through the delivery spout of the fixture such that the liquid soap does not come into contact with the delivery spout.

While the arrangement of Brandenburg has been effective at overcoming various drawbacks of prior arrangements, further room for improvement exists in the art.

SUMMARY OF THE INVENTION

The present invention recognizes and addresses the foregoing disadvantages, and others, of prior art constructions and methods. Accordingly, it is an object of the present invention to provide novel arrangements for a counter-mounted viscous liquid dispenser.

It is a further object of the present invention to provide a counter-mounted viscous liquid dispenser having an improved liquid reservoir assembly.

It is a more particular object of the present invention to provide a liquid reservoir assembly for a counter-mounted viscous liquid dispenser which is made using mass-produced components.

It is a more particular object of the present invention to provide a liquid reservoir for a counter-mounted viscous liquid dispenser which permits versatility in its use.

Some of these objects are achieved by a reservoir assembly for use with a counter-mounted dispenser having an actuator element operatively movable to cause a viscous liquid (such as soap, antibacterial hand cleaner, lotion or the like) to be dispensed. The assembly comprises a container housing for containing therein a quantity of the viscous liquid. The container housing has a top portion defining at least one actuator opening for receipt of the actuator element. A pump device, located within the container housing, is operative to pump the viscous liquid through a fluid outlet.

The pump device of the reservoir includes a tubular piston axially movable within a pump cylinder such that reciprocative movement of the tubular piston causes the viscous liquid to be drawn through the tubular piston and moved toward the fluid outlet. An engaging element is fixedly connected to the tubular piston for movement therewith. The engaging element has a contact portion registered with the actuator opening to be engaged by the actuator element.

In some exemplary embodiments, the reservoir assembly further comprises a pump mounting structure, fixedly connected to the container housing, to which the pump device is attached. Often, the pump mounting structure may be configured having a threaded portion defining outer threads. In this case, the pump device may further comprise a cap element defining inner threads engaging the outer threads. The top portion of the container housing may include a depending cylinder extending from an inner surface thereof, with the pump mounting structure being attached to the depending cylinder.

Typically, the fluid outlet may be located on the top portion of the container housing. The fluid outlet may be configured having a cylindrical receiving portion into which an end portion of the tubular piston extends for reciprocative movement. A sealing element is preferably located between an inner surface of the cylindrical receiving portion and an outer surface of the end portion of the tubular piston. A flexible delivery tube preferably extends from the fluid outlet for slidable receipt in the delivery spout of the counter-mounted dispenser.

In many cases, the pump device may be configured including first and second check valves, with one of the check valves being located inside of the tubular piston. Often, the check valves may be configured as ball and seat valves.

The top portion of the container housing may be configured to define a pair of diametrically opposed actuator openings. In such embodiments, the engaging element is configured to have contact portions registered with respective of the actuator openings.

In some exemplary embodiments, the container housing may be adapted for direct attachment to a canister top of the counter-mounted dispenser. For example, the container housing may include a plurality of bayonet tabs for effecting direct attachment to the canister top. In some cases, uniform bayonet tabs may be provided for allowing attachment of the container housing to the canister top in multiple orientations. Alternatively, nonuniform bayonet tabs may be provided for allowing attachment of the container housing to the canister top in a single orientation.

Other objects of the present invention are achieved by a reservoir assembly for use with a counter-mounted dispenser having an actuator element operatively movable to cause a viscous liquid to be dispensed. The assembly comprises a container housing having a top portion defining at least one actuator opening for receipt of the actuator element. A pump device, located within the container housing, is operative to pump the viscous liquid through a fluid outlet. The pump device comprises a cap element defining inner threads.

The reservoir further includes a pump mounting structure fixedly connected to the container housing. The pump mounting structure has a threaded portion defining outer threads engaging the inner threads of the cap element. An engaging element, operative to cause actuation of the pump device, has a contact portion registered with the actuator opening so as to be engaged by the actuator element.

In some exemplary embodiments, the top portion of the container housing includes a depending cylinder extending from an inner surface thereof, with the pump mounting structure being attached to the depending cylinder. Often, the pump device may include first and second check valves such that one of the check valves is located inside of a tubular piston. An elongate intake tube may be provided, extending from the pump device to a bottom portion of the container housing. A flexible delivery tube may extend from the fluid outlet for slidable receipt in a delivery spout of the counter-mounted dispenser.

Often, the top portion of the container housing may be configured defining a pair of diametrically opposed actuator openings. In such embodiments, the engaging element is configured to have contact portions registered with respective of the actuator openings. The container housing may be configured including a plurality of bayonet tabs for effecting direct attachment to the canister top.

Still further objects of the present invention are achieved by a reservoir assembly for use with a counter-mounted dispenser having an actuator element operatively movable to cause a viscous liquid to be dispensed. The assembly comprises a container housing having a top portion defining at least one actuator opening for receipt of the actuator element. The top portion further includes a plurality of bayonet tabs for effecting direct attachment to a canister top of the counter-mounted dispenser.

The reservoir further includes a pump mounting structure fixedly connected to the top portion of the container housing. A pump device, located within the container housing, is attached to the pump mounting structure. The pump device is operative to pump the viscous liquid through a fluid outlet defined in the top portion of the container housing. An engaging element, operative to cause actuation of the pump device, has a contact portion registered with the actuator opening to be engaged by the actuator element.

An elongate intake tube is also provided, extending from the pump device to a bottom portion of the container housing. A flexible delivery tube, extending from the fluid outlet, is slidable into and out of a delivery spout of the counter-mounted dispenser.

In some exemplary embodiments, the top portion of the container housing includes a depending cylinder extending from an inner surface thereof, with the pump mounting structure being attached to the depending cylinder. In this case, the pump device may comprise a cap element defining inner threads engaging outer threads defined on a threaded portion of the pump mounting structure.

Typically, the pump device may include a tubular piston axially movable within a pump cylinder such that reciprocative movement of the tubular piston causes the viscous liquid to be drawn through the tubular piston and moved toward the fluid outlet. The fluid outlet may include a cylindrical receiving portion into which an end portion of the tubular piston extends for reciprocative movement. The pump device may include first and second check valves, one of which is located inside of the tubular piston.

Often, the top portion of the container housing will be a separate unit affixed to a main container of the container housing. Advantageously, the main container may be configured having a larger diameter container portion integrally extending to a smaller diameter throat portion, with the top portion being affixed to the throat portion.

Additional objects of the present invention are achieved by a counter-mounted viscous liquid dispenser apparatus. The apparatus comprises a dispenser fixture including a tubular delivery spout and an actuator rod. The actuator rod is reciprocatively movable and has a free distal end located below the counter. The dispenser fixture further includes a fixed canister top having bayonet receiving slots.

In addition, the dispenser apparatus comprises a refill reservoir assembly including a container housing having a top portion defining a pair of diametrically opposed actuator openings for receipt of the actuator element. The top portion further includes a plurality of bayonet tabs for effecting direct attachment to the canister top via bayonet receiving slots thereof. A pump device, located within the container housing, is operative to pump the viscous liquid through a fluid outlet defined in the top portion of the container housing. An engaging element, operative to cause actuation of the pump device, has a contact portion registered with the actuator openings to be engaged by the actuator element. In addition, the reservoir includes a flexible delivery tube extending from the fluid outlet. The flexible delivery tube is slidable into and out of the delivery spout of the dispenser fixture.

Other objects, features and aspects of the present invention are achieved by various combinations and subcombinations of the disclosed elements, which are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which.

Figure 1:
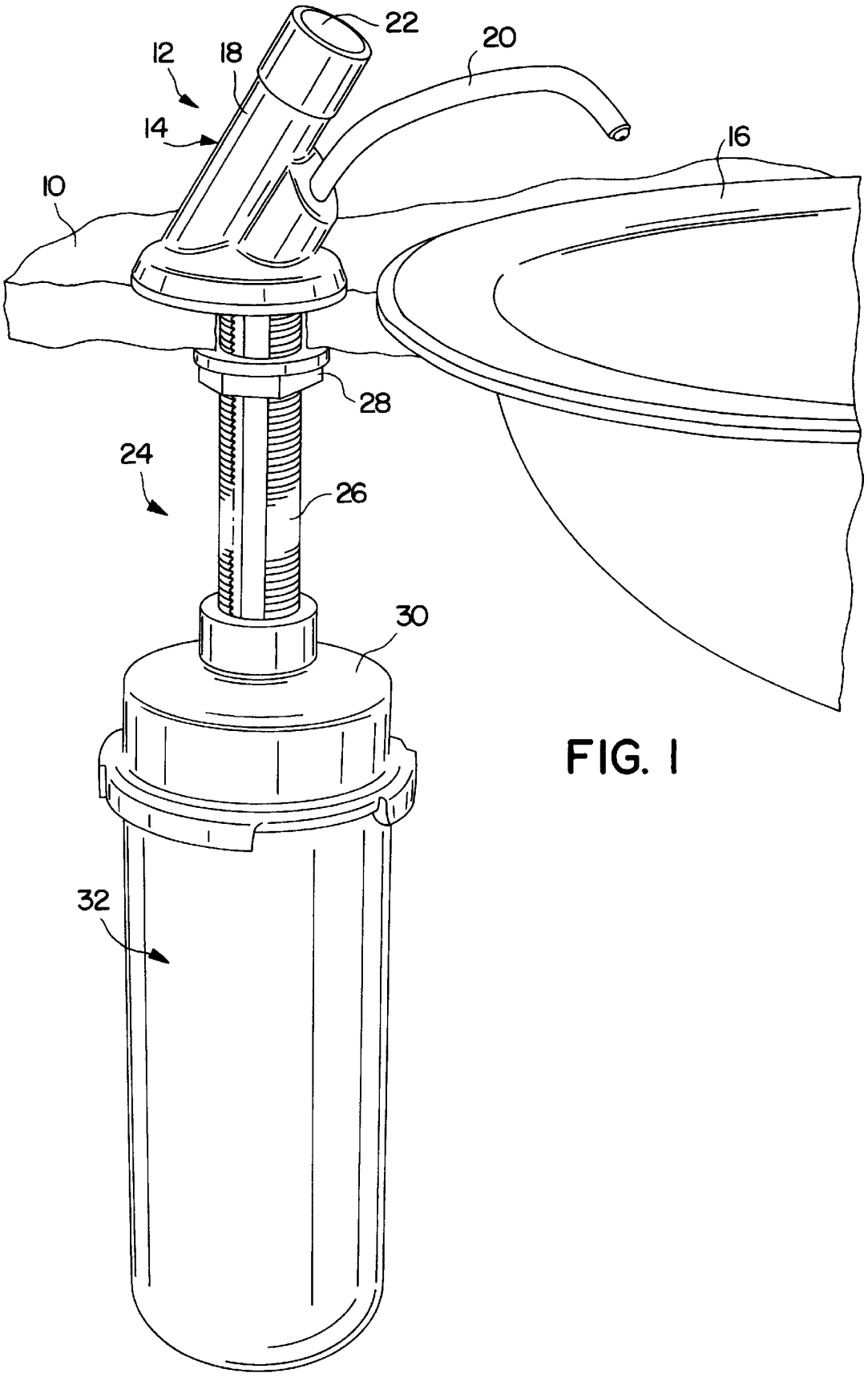
FIG. 1 illustrates a counter-mounted viscous liquid dispenser of the present invention installed on a washroom counter.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary constructions.

FIG. 1 illustrates a dispenser apparatus of the present invention, mounted to a counter 10 in a typical washroom facility. As shown, the dispenser apparatus includes a dispenser fixture 12 having an above-counter portion 14 located adjacent to a sink bowl 16. As shown, above-counter portion 14 includes a stationary frame 18 having a delivery spout 20 extending therefrom. Delivery spout 20 is configured in a conventional manner to supply soap or other viscous liquid to the hand of a user. An actuation button 22 is depressed by the user when a quantity of the soap is desired.

Dispenser fixture 12 includes an under-counter portion 24 having a threaded tube 26 extending through a hole defined in counter 10. As a result, the fixture may be secured to counter 10 using a suitable nut 28. A canister top 30, located at the distal end of tube 26, supports a refill reservoir 32.

Figure 2:
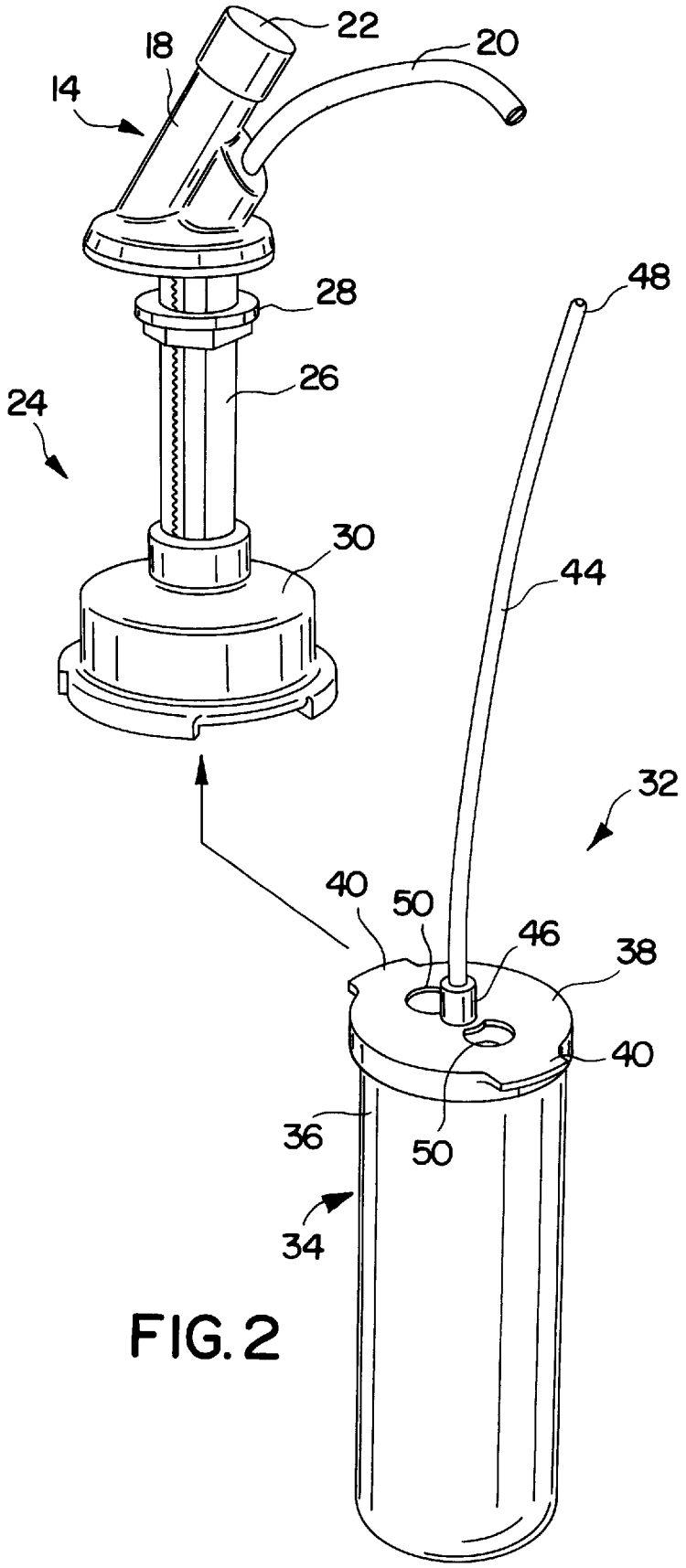
FIG. 2 is a perspective view of the dispenser of FIG. 1, uninstalled and with the reservoir assembly separated from the dispenser fixture.
Figure 3:
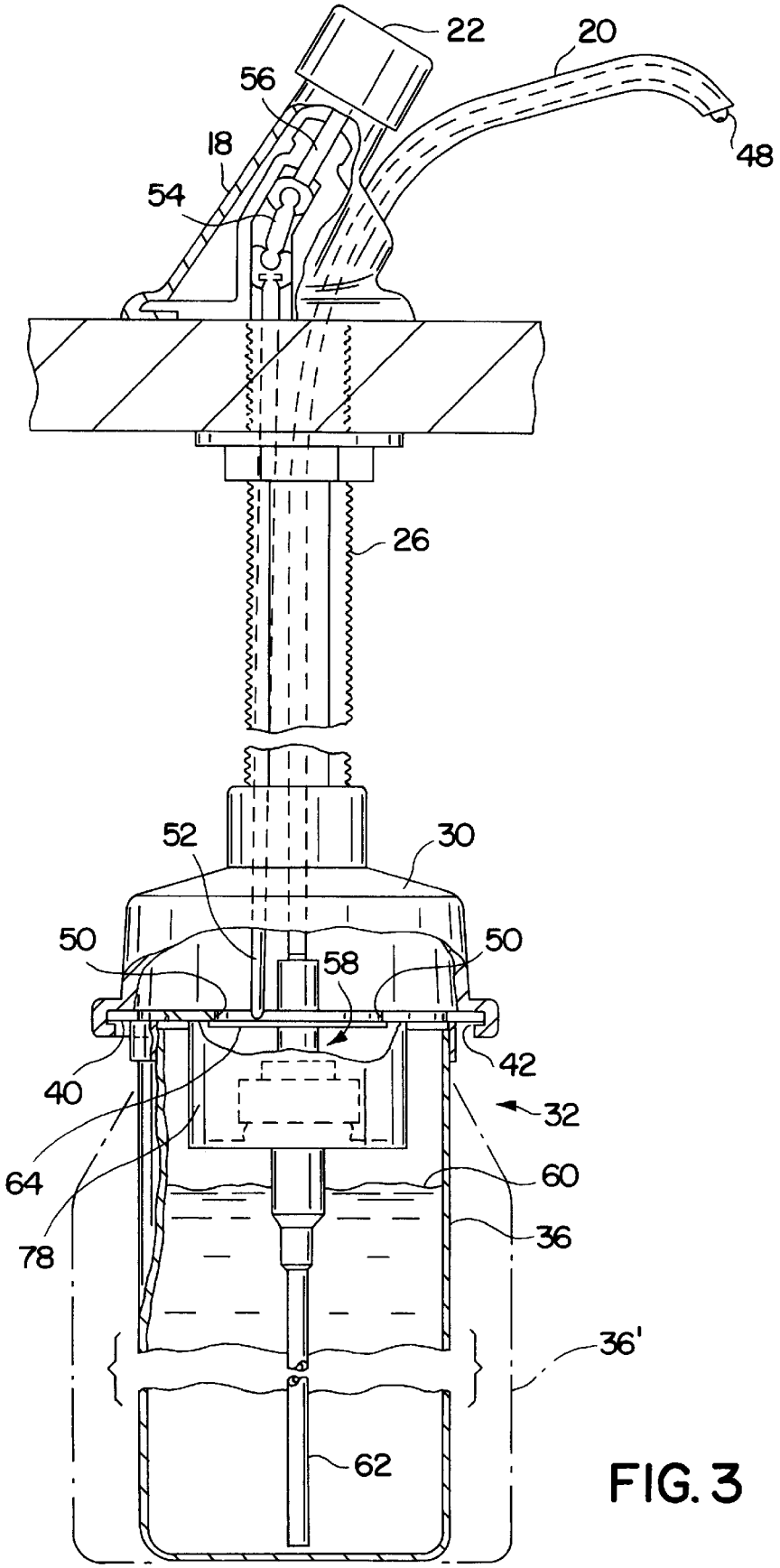
FIG. 3 is an elevational view, partially in section, of the counter-mounted viscous liquid dispenser shown in the preceding figures.

Referring now to FIGS. 2 and 3, reservoir 32 includes a container housing 34 having a main container 36 to which a top portion 38 is secured. In presently preferred embodiments, top portion 38 is sealed to main container 36 using ultrasonic welding, adhesive or other suitable means of effecting a "permanent" attachment. As shown, top portion 38 includes a plurality of radial bayonet tabs 40 adapted for receipt in suitable bayonet receiving slots 42 (FIG. 3) located on canister top 30.

A flexible delivery tube 44 extends from a fluid outlet 46 on top portion 38 for slidable receipt in delivery spout 20. The length of tube 44 is preferably selected such that hemispherical end 48 thereof will reside just beyond the end of spout 20. As a result, liquid soap will not come into contact with the inner surface of spout 20 as the soap is being dispensed.

In this case, top portion 38 defines a pair of actuator openings 50 diametrically opposed across the fluid outlet 46. As can be seen most clearly in FIG. 3, the dispenser fixture includes an actuator rod 52 that extends through one of the actuator openings when reservoir 32 is installed. Because two actuator openings are provided, actuator rod 52 will be received in one of the actuator openings irrespective of the orientation in which reservoir 32 is installed.

As shown, actuator rod 52 is connected via a linkage element 54 to a rod segment 56. In turn, rod segment 56 is attached to actuation button 22. Actuator rod 52 will thus be moved in a vertical downward direction when a user pushes actuation button 22.

A pump device 58 is located inside of reservoir 32 to draw liquid soap (indicated at 60) into an intake tube 62. The liquid soap passes through the pump, and is pushed out through delivery tube 44. The pump is actuated by reciprocative movement of an engaging element 64 having contact portions registered with actuator openings 50. The free distal end of actuator rod 52 thus pushes against a contact portion of engaging element 64 when a user pushes actuation button 22.

Figure 4:
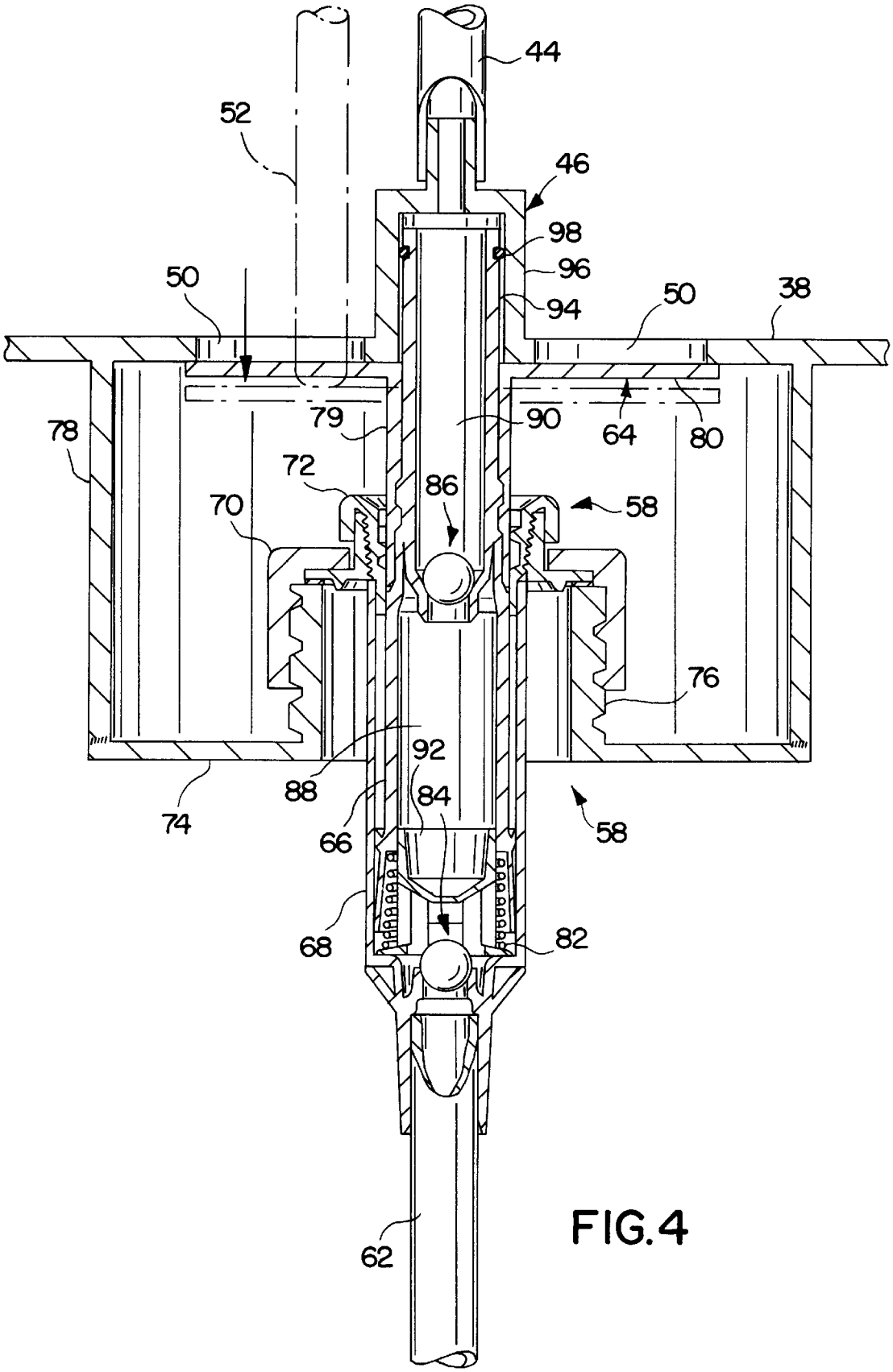
FIG. 4 is an enlarged cross-sectional view of the pump device used in the reservoir assembly of the preceding figures.

Referring now to FIG. 4, pump device 58 is advantageously constructed from widely available "stock" components in order to enhance manufacturing efficiencies. Specifically, pump device 58 is preferably a common "lotion pump" of the type in widespread use with bottled lotions, shampoos and the like. One such pump that may be suitable for this purpose in some applications is Model SD-200, available from Calmar, Inc. Many other models of lotion pumps are also available on the market, however, and may be utilized depending on variables such as shot size and the like. As will be explained below, the lotion pump is modified in several ways for use in reservoir 32.

As shown, pump device 58 includes a tubular piston 66 located inside of a pump cylinder 68. Pump device 58 further includes a cap element 70, which is maintained in an axially fixed relation with respect to pump cylinder 68 by virtue of a chaplet 72. In a traditional application for a pump of this type, cap element 70 would be threaded onto the throat of a bottle. In this case, however, cap element 70 is advantageously utilized to mount pump device 58 within reservoir 32.

As can be seen, reservoir 32 includes a pump mounting element 74 fixedly connected to the container housing. In the illustrated embodiment, for example, mounting element 74 is configured as a disc-shaped member having a threaded portion 76. The outer threads of threaded portion 76 are engaged by the inner threads of cap element 70, as shown. The periphery of mounting element 74 is affixed by welding, adhesive or other suitable means to the bottom of a depending cylinder 78. Depending cylinder 78 extends, as shown, from the bottom surface of top portion 38.

As a further modification to the standard lotion pump, engaging element 64 is fixed to the pump's piston 66. In the illustrated embodiment, engaging element 64 is configured having a cylindrical portion 79, and a disc-shaped flange which forms contact portion 80. Thus, reciprocative movement of engaging element 64 will cause piston 66 to move within the cylinder. Piston 66 is normally urged into an upward position due to the force of a helical spring 82.

Pump device 58 is further provided with a pair of check valves 84 and 86 to ensure proper flow of the viscous liquid. Check valve 84, located at the base of pump cylinder 68, allows viscous liquid to be drawn into a lower pump chamber 88 when piston 64 moves in a upward direction. When piston 64 moves in a downward direction, check valve 86 allows the viscous liquid to be passed into an upper pump chamber 90. As a result, the viscous liquid will be pumped into and through flexible tube 44. While a variety of different check valve configurations are contemplated, the illustrated embodiment utilizes common ball and seat valves. In typical fashion, a suitable cage 92 may be provide in lower chamber 88 as shown.

In a usual application of a lotion pump, the pump's eductor (i.e., the portion of piston 66 located above check valve 86) is often equipped with a dispenser head that is pushed by a user. Because a dispenser head is undesirable in this case, eductor 94 is simply terminated inside of fluid outlet 46. As shown, eductor 94 reciprocatively moves in a tubular receiving portion 96 of fluid outlet 46. A seal element 98, here in the form of a suitable O-ring seal, is provided extending between the outer surface of eductor 94 and the inner surface of receiving portion 96. The viscous liquid is thus more fully directed only into flexible tube 44.

Figure 5:
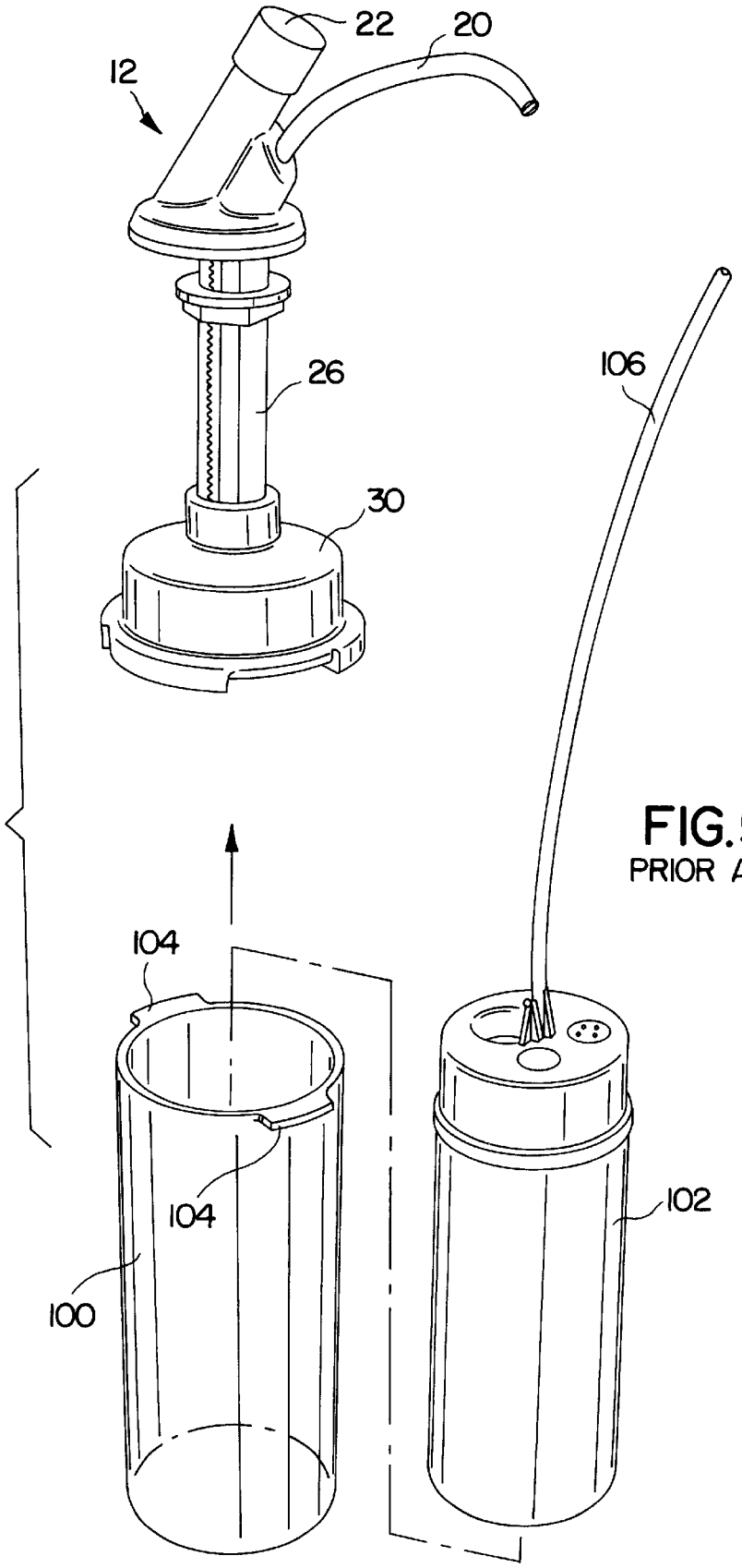
FIG.5 PRIOR ART
FIG. 5 is a view of a prior art dispenser, uninstalled and with the canister and refill cartridge separated from the dispenser fixture.
Figure 6:
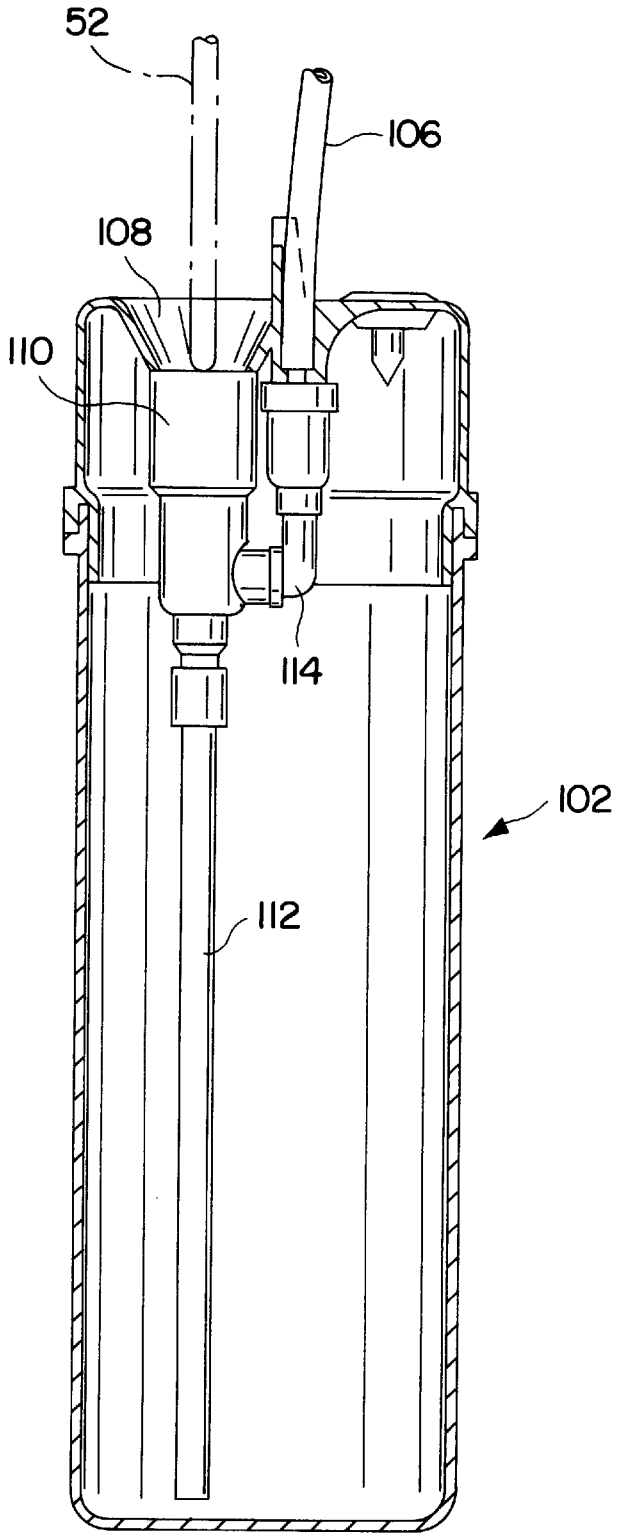
FIG. 6 PRIOR ART
FIG. 6 is an enlarged view, partially in section, of a refill cartridge used in the prior art arrangement of FIG. 5.

A prior art arrangement is illustrated in FIGS. 5 and 6 for purposes of comparison. As shown in FIG. 5, the prior art arrangement includes a dispenser fixture identical to that described above. A canister 100 receives a refill cartridge 102 in which the viscous liquid is contained. As shown, canister 100 includes bayonet tabs 104 for engagement with bayonet slots carried by canister top 30. Refill cartridge 102 includes a flexible delivery tube 106 for insertion into delivery spout 20 in the manner described above.

Referring now also to FIG. 6, further details of refill cartridge 102 will be explained. The top portion of refill cartridge 102 defines a single actuator opening 108 into which actuator rod 52 is received. The free distal end of actuator rod 52 thus engages the head of a movable piston within an internal pump device 110. Operation of pump device 110 causes viscous liquid to be drawn into an intake tube 112. The viscous fluid is forced into a lateral tube 114, and along the flexible delivery tube 106.

While this prior art arrangement has worked well for its intended purpose, the present invention offers certain improvements. For example, it will be appreciated that the prior art design required skill by maintenance personnel in order to ensure that the refill cartridge was oriented correctly in the canister. Preferred embodiments of the present invention, however, eliminate this margin for error by providing the reservoir itself with bayonet tabs. The bayonet tabs ensure that, when installed, the reservoir will be in a proper orientation for use.

Elimination of the canister also allows the main container of the reservoir to have a larger diameter than the throat at which it is attached to the canister top. This is shown, for example, in FIG. 3, where the main canister 36' is shown to be greatly enlarged. As a result, a larger quantity of viscous liquid may be contained. In addition, as described above, many embodiments of the invention make a greater use of "off-the-shelf" components, which are widely available.

Figure 7A:
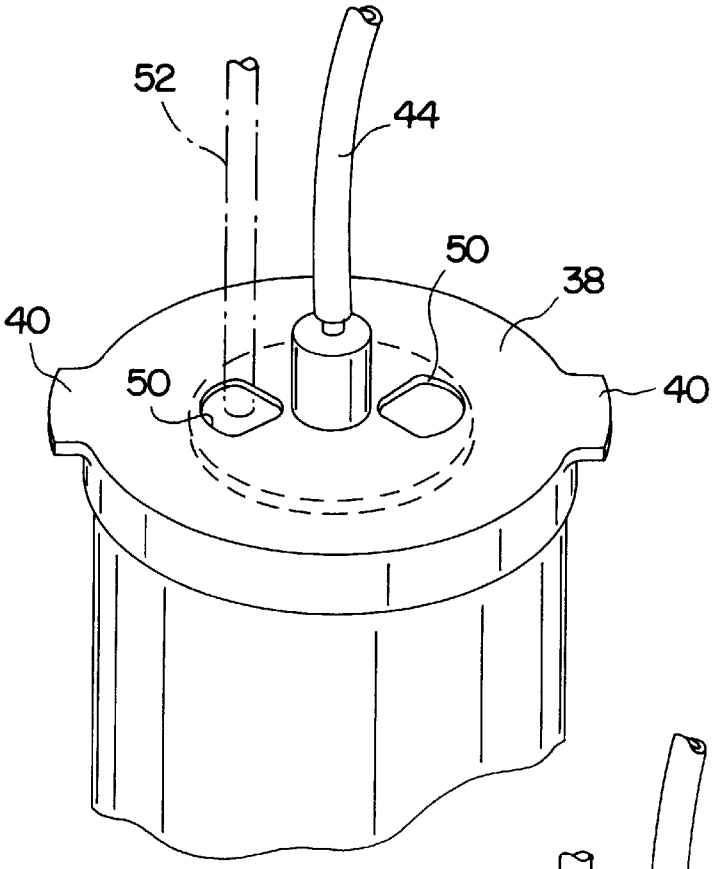
FIGS. 7A and 7B are enlarged fragmentary views showing two alternative configurations of a reservoir assembly constructed in accordance with the present invention.
Figure 7B:
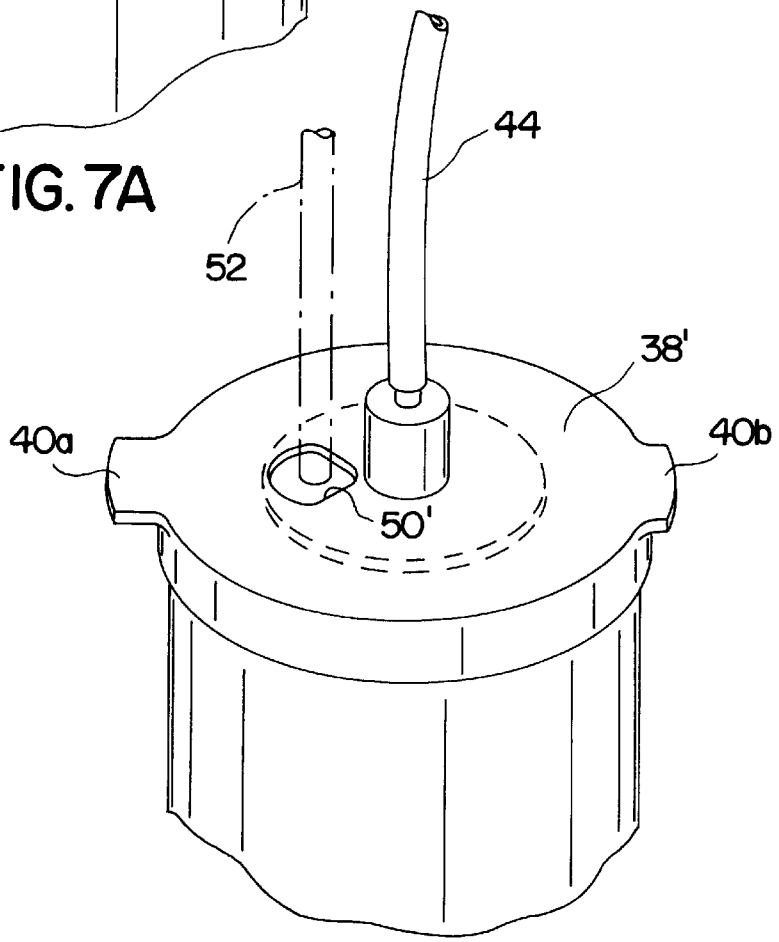

Referring to FIG. 7A, symmetrical bayonet tabs are provided in reservoir 32 to permit installation in either of two orientations. Thus, as noted above, two actuator openings 50 are provided in top portion 38 of the container housing. Alternatively, as shown in FIG. 7B, asymmetrical bayonet tabs 40*a* and 40*b* may be provided to permit installation in only one orientation. In this case, top portion 38' may be provided with only a single actuation opening 50'.

It can thus be seen that the present invention provides an improved counter-mounted viscous liquid dispenser arrangement in furtherance of the objects set forth above. While preferred embodiments of the invention have been shown and described, modifications and variations may be made thereto by those of ordinary skill in the art without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to be limitative of the invention so further described in such appended claims.

What is claimed is:

1. A reservoir assembly for use with a counter-mounted dispenser having an actuator element operatively movable to cause a viscous liquid to be dispensed, said assembly comprising:

a container housing for containing therein a quantity of the viscous liquid, said container housing having a top portion defining at least one actuator opening for receipt of the actuator element;

a pump device located within said container housing and operative to pump the viscous liquid through a fluid outlet;

said pump device having a tubular piston axially movable within a pump cylinder such that reciprocatively movement of said tubular piston causes the viscous liquid to be drawn through said tubular piston and moved toward said fluid outlet; and an engaging element fixedly connected to said tubular piston for movement therewith, said engaging element having a contact portion registered with said actuator opening so as to be engaged by the actuator element.

2. A reservoir assembly as set forth in claim 1, further comprising a mounting structure to which said pump device is attached, said mounting structure being fixedly connected to said container housing.

3. A reservoir assembly as set forth in claim 2, wherein said mounting structure has a threaded portion defining outer threads, said pump device further comprising a cap element defining inner threads engaging said outer threads.

4. A reservoir assembly as set forth in claim 2, wherein said top portion of said container housing includes a depending cylinder extending from an inner surface thereof, said mounting structure being attached to said depending cylinder.

5. A reservoir assembly as set forth in claim 1, wherein said fluid outlet is located on said top portion of said container housing, said fluid outlet including a cylindrical receiving portion into which an end portion of said tubular piston extends for reciprocative movement.

6. A reservoir assembly as set forth in claim 5, comprising a sealing element located between an inner surface of said cylindrical receiving portion and an outer surface of said end portion of said tubular piston.

7. A reservoir assembly as set forth in claim 1, wherein said pump device includes first and second check valves, one of said check valves being located inside of said tubular piston.

8. A reservoir assembly as set forth in claim 7, wherein said check valves are ball and seat valves.

9. A reservoir assembly as set forth in claim 1, wherein said top portion of said container housing defines a pair of diametrically opposed actuator openings, said engaging element being configured to have contact portions registered with respective of said actuator openings.

10. A reservoir assembly as set forth in claim 1, wherein said container housing is adapted for direct attachment to a canister top of the counter-mounted dispenser.

11. A reservoir assembly as set forth in claim 10, wherein said container housing includes a plurality of bayonet tabs for effecting direct attachment to the canister top.

12. A reservoir assembly as set forth in claim 11, wherein said plurality of bayonet tabs comprises uniform bayonet tabs for allowing attachment of said container housing to the canister top in multiple orientations.

13. A reservoir assembly as set forth in claim 11, wherein said plurality of bayonet tabs comprises nonuniform bayonet tabs for allowing attachment of said container housing to the canister top in a single orientation.

14. A reservoir as set forth in claim 1, comprising a flexible delivery tube extending from said fluid outlet, said flexible delivery tube being slidable into and out of a delivery spout of the counter-mounted dispenser.

15. A reservoir assembly for use with a counter-mounted dispenser having an actuator element operatively movable to cause a viscous liquid to be dispensed, said assembly comprising:

a container housing having a top portion defining at least one actuator opening for receipt of the actuator element;

a pump device located within said container housing and operative to pump the viscous liquid through a fluid outlet, said pump device comprising a cap element defining inner threads;

a mounting structure fixedly connected to said container housing, said mounting structure having a threaded portion defining outer threads engaging said inner threads of said cap element;

an engaging element operative to cause actuation of said pump device, said engaging element having a contact portion registered with said actuator opening so as to be engaged by the actuator element.

16. A reservoir assembly as set forth in claim 15, wherein said top portion of said container housing includes a depending cylinder extending from an inner surface thereof, said mounting structure being attached to said depending cylinder.

17. A reservoir assembly as set forth in claim 15, wherein said pump device includes first and second check valves, one of said check valves being located inside of a tubular piston.

18. A reservoir assembly as set forth in claim 15, comprising an elongate intake tube extending from said pump device to a bottom portion of said container housing.

19. A reservoir assembly as set forth in claim 18, comprising a flexible delivery tube extending from said fluid outlet, said flexible delivery tube being slidable into and out of a delivery spout of the counter-mounted dispenser.

20. A reservoir assembly as set forth in claim 15, wherein said top portion of said container housing defines a pair of diametrically opposed actuator openings, said engaging element being configured to have contact portions registered with respective of said actuator openings.

21. A reservoir assembly as set forth in claim 20, wherein said container housing includes a plurality of bayonet tabs for effecting direct attachment to the canister top.

22. A reservoir assembly for use with a counter-mounted dispenser having an actuator element operatively movable to cause a viscous liquid to be dispensed, said assembly comprising:

a container housing having a top portion defining at least one actuator opening for receipt of the actuator element, said top portion further including a plurality of bayonet tabs for effecting direct attachment to a canister top of the counter-mounted dispenser;

a mounting structure fixedly connected to said top portion of said container housing;

a pump device located within said container housing and attached to said mounting structure, said pump device being operative to pump the viscous liquid through a fluid outlet defined in said top portion of said container housing;

an engaging element operative to cause actuation of said pump device, said engaging element having a contact portion registered with said actuator opening to be engaged by the actuator element;

an elongate intake tube extending from said pump device to a bottom portion of said container housing; and a flexible delivery tube extending from said fluid outlet, said flexible delivery tube being slidable into and out of a delivery spout of the counter-mounted dispenser.

23. A reservoir assembly as set forth in claim 22, wherein said top portion of said container housing includes a depending cylinder extending from an inner surface thereof, said mounting structure being attached to said depending cylinder.

24. A reservoir assembly as set forth in claim 23, wherein said pump device comprises a cap element defining inner threads, said mounting structure having a threaded portion defining outer threads engaging said inner threads of said cap element.

25. A reservoir assembly as set forth in claim 22, wherein said pump device includes a tubular piston axially movable within a pump cylinder such that reciprocal movement of said tubular piston causes the viscous liquid to be drawn through said tubular piston and moved toward said fluid outlet.

26. A reservoir assembly as set forth in claim 25, wherein said fluid outlet includes a cylindrical receiving portion into which an end portion of said tubular piston extends for reciprocative movement.

27. A reservoir assembly as set forth in claim 25, wherein said pump device includes first and second check valves, one of said check valves being located inside of said tubular piston.

28. A reservoir assembly as set forth in claim 22, wherein said plurality of bayonet tabs comprises uniform bayonet tabs for allowing attachment of said container housing to the canister top in multiple orientations.

29. A reservoir assembly as set forth in claim 22, wherein said plurality of bayonet tabs comprises nonuniform bayonet tabs for allowing attachment of said container housing to the canister top in a single orientation.

30. A reservoir assembly as set forth in claim 22, wherein said top portion of said container housing is a separate unit affixed to a main container of said container housing.

31. A reservoir assembly as set forth in claim 30, wherein said main container is configured having a larger diameter container portion integrally extending to a smaller diameter throat portion, said top portion being affixed to said throat portion.

32. A counter-mounted viscous liquid dispenser apparatus, said apparatus comprising:

A. a dispenser fixture including:

i. a tubular delivery spout;

ii. an actuator rod having a free distal end located below the counter, said actuator rod being reciprocatively movable; and iii. a fixed canister top having bayonet receiving slots; and B. a refill reservoir assembly including:

i. a container housing having a top portion defining a pair of diametrically opposed actuator openings for receipt of the actuator element, said top portion further including a plurality of bayonet tabs for effecting direct attachment to said canister top via said bayonet receiving slots thereof;

ii. a pump device located within said container housing, said pump device being operative to pump the viscous liquid through a fluid outlet defined in said top portion of said container housing;

iii. an engaging element operative to cause actuation of said pump device, said engaging element having a contact portion registered with said actuator openings to be engaged by the actuator element; and iv. a flexible delivery tube extending from said fluid outlet, said flexible delivery tube being slidable into and out of said delivery spout of said dispenser fixture.

* * * * *